US012044106B2

(12) United States Patent
Yin et al.

(10) Patent No.: US 12,044,106 B2
(45) Date of Patent: Jul. 23, 2024

(54) DEEP-WATER DRILLING GAS KICK PILOT-SCALE APPARATUS

(71) Applicant: China University of Petroleum-Beijing, Beijing (CN)

(72) Inventors: Qishuai Yin, Beijing (CN); Laibin Zhang, Beijing (CN); Jin Yang, Beijing (CN)

(73) Assignee: China University of Petroleum-Beijing, Beijing (CN)

( * ) Notice: Subject to any disclaimer, the term of this patent is extended or adjusted under 35 U.S.C. 154(b) by 274 days.

(21) Appl. No.: 17/697,411

(22) Filed: Mar. 17, 2022

(65) Prior Publication Data

US 2023/0296002 A1 Sep. 21, 2023

(51) Int. Cl.
*E21B 41/00* (2006.01)
*E21B 21/08* (2006.01)

(52) U.S. Cl.
CPC ..... *E21B 41/00* (2013.01); *E21B 21/08* (2013.01); *E21B 2200/20* (2020.05)

(58) Field of Classification Search
None
See application file for complete search history.

(56) References Cited

U.S. PATENT DOCUMENTS

2003/0010500 A1* 1/2003 Smith ..... E21B 47/001 166/336
2003/0062199 A1* 4/2003 Gjedebo ..... E21B 21/001 175/71
2020/0056477 A1* 2/2020 Yang ..... E21B 21/01

FOREIGN PATENT DOCUMENTS

CN 204113272 U 1/2015
CN 106368607 A 2/2017
CN 206816213 U 12/2017
CN 108425651 A 8/2018
CN 109386279 A 2/2019
CN 208900028 U 5/2019
CN 110853475 A 2/2020
CN 111028648 A 4/2020
CN 113250617 A 8/2021
(Continued)

OTHER PUBLICATIONS

Yin Bangtang et al., Petroleum Exploration and Development, A gas kick early detection method outside riser based on Doppler ultrasonic wave during deepwater drilling, vol. 47 No. 4.
(Continued)

*Primary Examiner* — Brandi N Hopkins
*Assistant Examiner* — Nigel H Plumb
(74) *Attorney, Agent, or Firm* — Young Basile Hanlon & MacFarlane, P.C.

(57) ABSTRACT

A deep-water drilling gas kick pilot-scale apparatus, including: a simulation wellbore having an upper wellbore transitioned to a lower wellbore through a variable cross section; a drilling tool with an annular space formed between the drilling tool and the simulation wellbore; a gas-injection system, comprising an air compressor and a gas-injection pipeline; a mud circulation system, comprising a mud supply source, a first pump, a second pump, and a mud-return pipeline; a Coriolis mass flowmeter provided on the mud-return pipeline; a Doppler sensor installed on the upper wellbore; and a built-in pressure gauge carrier connected between a drill pipe and a drill bit.

10 Claims, 3 Drawing Sheets

(56) References Cited

FOREIGN PATENT DOCUMENTS

WO 2012166573 A2 12/2012

OTHER PUBLICATIONS

Yin et al., Downhole quantitative evaluation of gas kick during deepwater drilling, Journal of Petroleum Science and Engineering 208 (2022) 109136, 24 pgs.

Yin et al., Machine Learning for Deepwater Drilling: Gas-Kick-Alarm Classification Using Pilot-Scale Rig Data with Combined Surface-Riser-Downhole Monitoring, Downloaded from http://onepetro.org/SJ/article-pdf/doi/10.2118/205365-PA/2422320/spe-205365-pa.pdf/1 by University of Petroleum China Beijing user on Mar. 18, 2021, 27 pgs.

Chinese search report from potentially related Chinese patent application titled, "deep-water drilling gas kick pilot-scale apparatus" filed Dec. 16, 2021.

* cited by examiner

DEEP-WATER DRILLING GAS KICK PILOT-SCALE APPARATUS

TECHNICAL FIELD

The present disclosure relates to a technical field of marine drilling, and particularly to a deep-water drilling gas kick pilot-scale apparatus.

BACKGROUND

Drilling is essential for deep-water oil and gas exploration and development. However, since the deep-water drilling has a narrow pressure window, gas kick accidents occur frequently. The gas kick can evolve into an overflow or even blowout in a short period. If not detected and stopped early, the gas kick may lead to serious safety and environmental problems. Therefore, an early alarm of gas kick is especially important. A machine learning model, established for the early alarm of gas kick in the deep-water drilling, is helpful to realize a scientific and efficient early alarm of gas kick. However, it is difficult to establish a high-performance early alarm machine learning model due to the lack of gas kick sample data.

SUMMARY

An objective of the embodiments of the present disclosure is to provide a deep-water drilling gas kick pilot-scale apparatus, so as to obtain deep-water drilling gas kick sample data.

In order to achieve the above objective, the present disclosure provides a deep-water drilling gas kick pilot-scale apparatus, comprising: a simulation wellbore with a closed bottom, comprising an upper wellbore and a lower wellbore, a diameter of the upper wellbore being larger than that of the lower wellbore, and the upper wellbore being transitioned to the lower wellbore through a variable cross section: a drilling tool provided inside the simulation wellbore with an annular space formed between the drilling tool and the simulation wellbore, the drilling tool comprising a drill pipe and a drill bit: a gas-injection system, comprising an air compressor and a gas-injection pipeline, the gas-injection pipeline having a gas inlet end coupled to the air compressor and a gas outlet end coupled to the bottom of the simulation wellbore: a mud circulation system, comprising a mud supply source, a first pump configured to inject mud supplied by the mud supply source into the drilling tool, a second pump configured to inject the mud supplied by the mud supply source into the annular space from the variable cross section, and a mud-return pipeline configured to return mud in the annular space to the mud supply source: a Coriolis mass flowmeter provided on the mud-return pipeline: a Doppler sensor installed on the upper wellbore: and a built-in pressure gauge carrier connected between the drill pipe and the drill bit.

The advantageous effects of the deep-water drilling gas kick pilot-scale apparatus of the present disclosure include:

1. In the embodiments of the present disclosure, by providing the Coriolis mass flowmeter, the Doppler sensor, and the built-in pressure gauge carrier, the gas kick can be monitored at the wellhead, the drilling riser, and the downhole, so that the embodiments of the present disclosure have comprehensive monitoring functions of monitoring at the wellhead, the drilling riser and the downhole, thereby improving monitoring accuracy and providing accurate, large and multiple gas kick sample data for establishing a high-performance early warning machine learning model.

2. In the embodiments of the present disclosure, by providing the bypass pipe, an independent mud flow channel can be formed in the bypass pipe without being affected by the rotation of the drilling tool, thereby effectively avoiding the signal distortion of the Doppler sensor caused by the rotation of the drilling tool, and improving the monitoring accuracy.

BRIEF DESCRIPTION OF DRAWINGS

For clearer illustration of the embodiments in the present disclosure or the prior art, a brief description of the drawings for the embodiments or the prior art will be given below. Obviously, the drawings described below involve only some embodiments of this disclosure. For those of ordinary skill in the art, other drawings can be derived from these drawings without any inventive efforts. In the drawings.

DESCRIPTION OF REFERENCE NUMERALS IN THE DRAWINGS

1—simulation wellbore;
101—upper wellbore; 102—lower wellbore; 103—variable cross section; 104—main cylinder;
105—bypass pipe;
2—drilling tool; 201—drill pipe; 202—drill bit;
3—gas-injection system;
301—air compressor; 302—gas-injection pipeline; 303—gas inlet end; 304—gas outlet end;
305—solenoid valve; 306—gas flowmeter; 307—gas pressure transducer; 308—check valve;
4—mud circulation system;
401—mud supply source; 402, first pump; 403, second pump; 404, mud-return pipeline;
405—first mud injection pipeline; 406—second mud injection pipeline;
407—solenoid flowmeter;
5—Coriolis mass flowmeter;
6—Doppler sensor; 601—transmitter; 602—receiver;
7—built-in pressure gauge carrier; 8—comprehensive logging system;
9—data collector; 10—data processing system;
11—prefabricated rock pillar; 111—mudstone rock pillar; 112—sandstone rock pillar;
113—gas-injection hole;
12—test wellbore; 13—packer; 14—anchor.

DESCRIPTION OF EMBODIMENTS

For a better understanding of the technical features of the present disclosure, a clear and complete description of the embodiments of the present disclosure will be set forth with reference to the drawings. Obviously, the described embodiments are only a part, rather than all, of the embodiments of the present disclosure. All other embodiments derived by persons skilled in the art from the embodiments of the present disclosure without making inventive efforts shall fall within the scope of the present disclosure.

Figure 1:
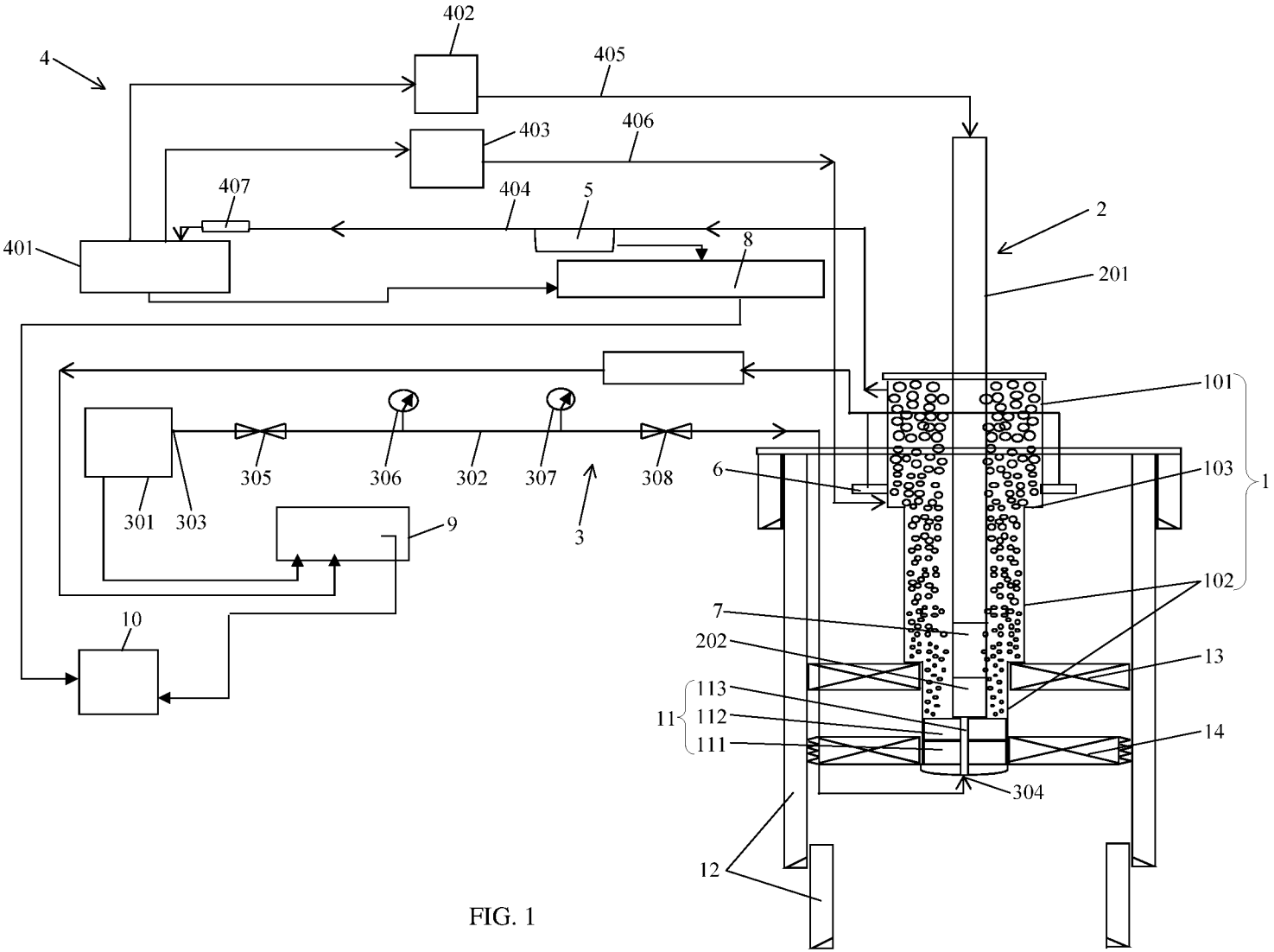
FIG. 1 is a schematic diagram of an example of a deep-water drilling gas kick pilot-scale apparatus according to an embodiment of the present disclosure.

An embodiment of the present disclosure provides a deep-water drilling gas kick pilot-scale apparatus. FIG. 1 is a schematic diagram of an example of a deep-water drilling gas kick pilot-scale apparatus according to an embodiment of the present disclosure.

As illustrated in FIG. 1, the deep-water drilling gas kick pilot-scale apparatus according to the embodiment of the present disclosure comprises a simulation wellbore 1, a drilling tool 2, a gas-injection system 3, a mud circulation system 4, a Coriolis mass flowmeter 5, a Doppler sensor 6 and a built-in pressure gauge carrier 7.

The simulation wellbore 1 has a closed bottom for simulating a bottom-hole. The simulation wellbore 1 comprises an upper wellbore 101 and a lower wellbore 102. The diameter of the upper wellbore 101 is larger than that of the lower wellbore 102. A variable cross section 103 is formed between the upper wellbore 101 and the lower wellbore 102. The upper wellbore 101 is capable of simulating a drilling riser. The variable cross section 103 is capable of simulating a blowout preventer, so the structure of the apparatus is simplified.

The drilling tool 2, which is provided inside the simulation wellbore 1, comprises a drill pipe 201 and a drill bit 202. An annular space is formed between the drilling tool 2 and the simulation wellbore 1.

The gas-injection system 3 comprises an air compressor 301 and a gas-injection pipeline 302. The gas-injection pipeline 302 has a gas inlet end 303 coupled to the air compressor 301 and a gas outlet end 304 coupled to a bottom of the simulation wellbore 1. Gas supplied by the air compressor 301 is injected into the bottom of the simulation wellbore 1 via the gas-injection pipeline 302 to simulate a bottom-hole gas kick.

The mud circulation system 4 comprises a mud supply source 401, a first pump 402 configured to inject mud supplied by the mud supply source 401 into the drilling tool 2, a second pump 403 configured to inject mud supplied by the mud supply source 401 into the annular space from the variable cross section 103, and a mud-return pipeline 404 configured to return mud in the annular space to the mud supply source 401. The mud injected into the drilling tool 2 by the first pump 402 is ejected from the drill bit 202, then the mud carrying rock cuttings returns upward in the annular space, flows out of the annular space and then returns to the mud supply source 401 via the mud-return pipeline 404, thereby realizing a process of mud circulation. When the mud enters the upper wellbore 101 via the variable cross section 103 in the course of the upward return of mud in the annular space, the rising velocity of the mud will suddenly decrease due to the large diameter of the upper wellbore 101. In order to prevent the rock cuttings from sinking due to the decrease of the rising velocity of the mud, the embodiment of the present disclosure further provides a second pump 403. The second pump 403 injects the mud at the variable cross section 103 to increase the rising velocity of the mud at the variable cross section 103, thereby preventing the rock cuttings from sinking.

In order to monitor the gas kick, the experimental apparatus of the embodiment of the present disclosure is provided with a Coriolis mass flowmeter 5, a Doppler sensor 6 and a built-in pressure gauge carrier 7.

The Coriolis mass flowmeter 5 is provided on the mud-return pipeline 404 and capable of monitoring the flow of the returned mud in real time. By comparing the flow of the returned mud with the discharge flow of the mud supply source 401, it is possible to monitor whether the gas kick occurs. If the flow of the returned mud is greater than the discharge flow of the mud supply source 401, it means that the gas kick occurs at the bottom-hole, thereby realizing the monitoring and early identification of the gas kick.

The Doppler sensor 6 is installed at an upper portion of the simulation wellbore 1. The Doppler sensor 6 can monitor whether there is gas in the mud in the annular space using ultrasonic waves. If there is gas in the mud, the ultrasonic waves of the Doppler sensor 6 may strike bubbles formed by the gas in the mud. As a result, the amplitude of the acoustic wave will suddenly increase and maintain at a high level until the bubbles gradually disappear. Utilizing this characteristic of the ultrasonic waves makes it possible to accurately monitor whether there is gas in the mud, thereby realizing monitoring functions and early identification of the gas kick.

The built-in pressure gauge carrier 7 is connected between the drill pipe 201 and the drill bit 202, and is capable of monitoring a bottom-hole pressure. Since the gas kick can lead to pressure change in the bottom-hole, the monitoring and early identification of the gas kick can also be realized by monitoring the pressure in the bottom-hole.

In the embodiment of the present disclosure, the gas kick can be monitored by the Coriolis mass flowmeter 5 at the wellhead, the Doppler sensor 6 at the drilling riser, and the built-in pressure gauge carrier 7 at the downhole. Therefore, the embodiment of the present disclosure has comprehensive monitoring functions of monitoring at the wellhead, drilling riser, and the downhole, thereby improving monitoring accuracy and providing large, accurate, and multiple gas kick sample data for establishing a high-performance early warning machine learning model.

Figure 2:
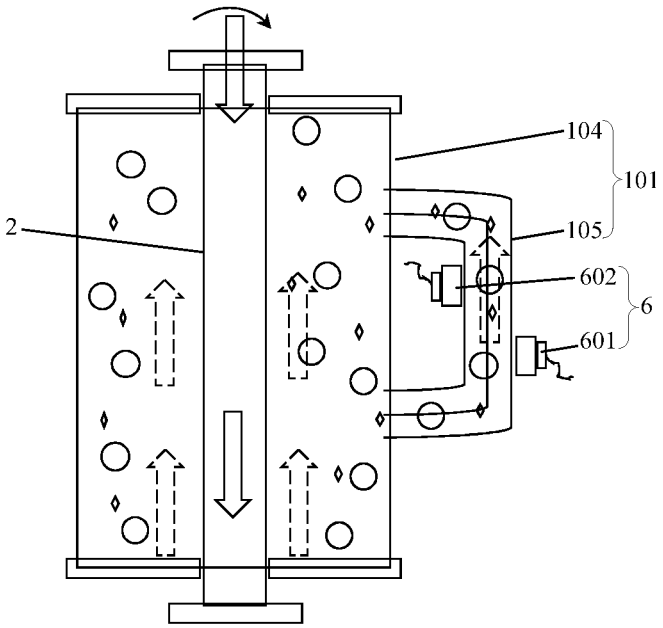
FIG. 2 is a schematic diagram of an example of an upper wellbore according to an embodiment of the present disclosure.
Figure 3:
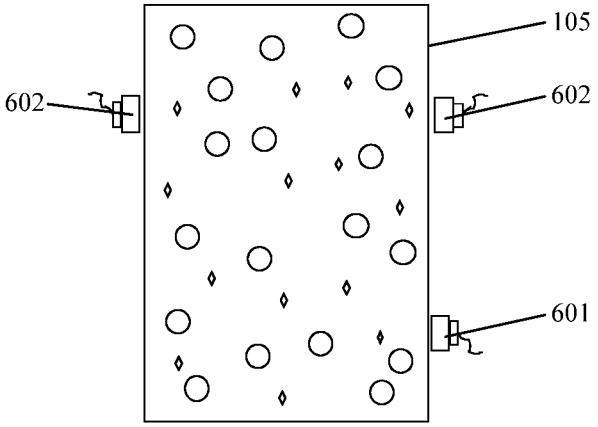
FIG. 3 is a front view of an example of a bypass pipe according to an embodiment of the present disclosure.

In some embodiments, as illustrated in FIG. 2, the upper wellbore 101 comprises a main cylinder 104 and a bypass pipe 105. The main cylinder 104 is coupled to the lower wellbore 102. The drilling tool 2 is located in the main cylinder 104. The bypass pipe 105 is located laterally of the main cylinder 104, and two ends of the bypass pipe 105 are coupled to and communicated with the main cylinder 104 respectively. The Doppler sensor 6 is installed on the bypass pipe 105. The solid arrows in FIG. 2 indicate a flow direction of the mud in the drilling tool 2, and the dashed arrows indicate flow directions of the mud in the annular space between the main cylinder 104 and the drilling tool 2 and in the bypass pipe 105.

In this embodiment, an independent mud flow channel is formed in the bypass pipe 105, without being affected by the rotation of the drilling tool 2, thereby effectively avoiding the signal distortion of the Doppler sensor 6 caused by the rotation of the drilling tool 2, and improving the accuracy of the gas kick monitoring.

Figure 4:
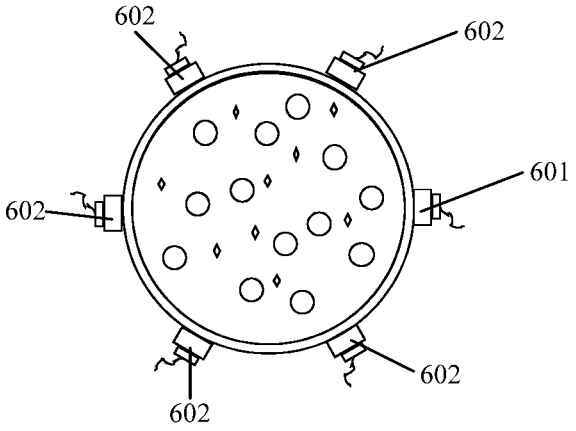
FIG. 4 is a top view of an example of a bypass pipe according to an embodiment of the present disclosure.

Further, as illustrated in FIGS. 1 and 4, the Doppler sensor 6 comprises a transmitter 601 and a plurality of receivers 602 installed on an outer sidewall of the bypass pipe 105. The plurality of receivers 602 are arranged at equal intervals along a circumferential direction of the bypass pipe 105 and located on a same radial section thereof. In an axial direction of the bypass pipe 105, the plurality of receivers 602 are located above the transmitter 601, i.e., the transmitter 601 is located at upstream of the mud flow channel in the bypass pipe 105, and the receivers 602 are located at downstream of the mud flow channel to receive acoustic signals offset along with the mud, thereby further improving the monitoring accuracy.

In some embodiments, as illustrated in FIG. 1, the Doppler sensor 6 is provided on the upper wellbore 101 adjacent to the variable cross section 103.

In some embodiments, as illustrated in FIG. 1, the experimental apparatus may further comprise a comprehensive logging system 8, which is electrically coupled to the Coriolis mass flowmeter 5, and capable of collecting and storing data of the Coriolis mass flowmeter 5 for subsequent data analysis and establishment of machine learning model.

In some embodiments, as illustrated in FIG. 1, the experimental apparatus may further comprise a data collector 9, which is electrically coupled to the air compressor 301 and the Doppler sensor 6, and capable of collecting and storing gas-injection data and ultrasonic wave data of the Doppler sensor 6 for subsequent data analysis and establishment of machine learning model. For example, the data collector 9 is a portable data collector.

In some embodiments, as illustrated in FIG. 1, the experimental apparatus may further comprise a data processing system 10, which is electrically coupled to the comprehensive logging system 8 and the data collector 9 for data processing and storage.

In some embodiments, as illustrated in FIG. 1, the first pump 402 may be coupled to the drilling tool 2 through a first mud injection pipeline 405, the second pump 403 may be coupled to the variable cross section 103 through a second mud injection pipeline 406, and the mud-return pipeline 404 is coupled to the mud supply source 401 and the upper wellbore 101.

In the example of FIG. 1, the top of the drilling tool 2 may be coupled to a top drive drilling system (not illustrated), and the first mud injection pipeline 405 is coupled to the top drive drilling system.

In some embodiments, as illustrated in FIG. 1, a solenoid valve 305, a gas flowmeter 306, a gas pressure transducer 307 and a check valve 308 may be provided on the gas-injection pipeline 302. The gas flowmeter 306 is capable of measuring gas-injection flow. The gas pressure transducer 307 is capable of measuring gas-injection pressure. The gas flowmeter 306 and the gas pressure solenoid 307 may be electrically coupled to the data collector 9.

In some embodiments, as illustrated in FIG. 1, the experimental apparatus may further comprise a prefabricated rock pillar 11 provided in the lower wellbore 102. The prefabricated rock pillar 11 comprises a plurality of mudstone rock pillars 111 and a plurality of sandstone rock pillars 112 alternately arranged along an axial direction of the lower wellbore 102 to simulate sandstone layer and mudstone layer respectively. The prefabricated rock pillar 11 is internally provided with an axially penetrating gas-injection hole 113 having a lower end communicated with the gas outlet end 304 of the gas-injection pipeline 302. The gas injected by the gas-injection pipeline 302 enters the wellbore via the gas-injection hole 113 and can interact with the rotating drill bit when the drill bit cuts through the rock pillar, so as to simulate the gas kick during drilling.

In some embodiments, as illustrated in FIG. 1, the experimental apparatus may further comprise a test wellbore 12, a packer 13 and an anchor 14. The simulation wellbore 1 is provided inside the test wellbore 12. The packer 13 and the anchor 14 are provided between the simulation wellbore 1 and the test wellbore 12.

In the example of FIG. 1, the simulation wellbore 1 comprises three cylinders connected in sequence from top to bottom of the simulation wellbore 1, and the diameters of the three cylinders decrease in sequence from top to bottom of the simulation wellbore 1. The uppermost cylinder serves as the upper wellbore 101 of the simulation wellbore 1. The lower two cylinders constitute the lower wellbore 102 of the simulation wellbore 1. The packer 13 is located at a joint position of the lower two cylinders. The anchor 14 is located below the packer 13. The prefabricated rock pillar 11 is located in the lowermost cylinder. The bottom of the lowermost cylinder may be closed by a plug to simulate the bottom-hole.

In the example of FIG. 1, the test wellbore 12 comprises three casings which are connected from top to bottom of the test wellbore 12, and the diameters of the three casings decrease in sequence from top to bottom of the test wellbore 12.

In some embodiments, as illustrated in FIG. 1, two built-in pressure gauge carriers 7 may be coupled between the drill pipe 201 and the drill bit 202, and one of the built-in pressure gauge carriers 7 serves as a spare to improve the experimental reliability.

In some embodiments, the upper wellbore 1 may be provided with two Doppler sensors 6, one of which serves as a spare and may be provided on the upper portion of the upper wellbore 1, preferably be provided above the ground, to avoid a possible damage during the process of putting down the simulation wellbore 1 into the well.

In some embodiments, as illustrated in FIG. 1, a solenoid flowmeter 407 may be provided on the mud-return pipeline 404 as a spare flowmeter to measure the flow of the returned mud when the Coriolis mass flowmeter 5 is damaged or blocked.

Described above is merely exemplary embodiments of the present disclosure, and is not meant to limit the present disclosure. Various modifications and variations may be made to the present disclosure by those skilled in the art. Any modifications, alternations, improvements, etc., made by those skilled in the art without departing from the concepts and principles of this disclosure shall fall within the scope of the claims.

What is claimed is:

1. A deep-water drilling gas kick simulation experimental apparatus, comprising:

a simulation wellbore with a closed bottom, comprising an upper wellbore and a lower wellbore, a diameter of the upper wellbore being larger than that of the lower wellbore, with a variable cross section formed between the upper wellbore and the lower wellbore;

a drilling tool provided inside the simulation wellbore with an annular space formed between the drilling tool and the simulation wellbore, the drilling tool comprising a drill pipe and a drill bit;

a gas-injection system comprising an air compressor and a gas-injection pipeline, the gas-injection pipeline having a gas inlet end coupled to the air compressor and a gas outlet end coupled to the bottom of the simulation wellbore;

a mud circulation system comprising a mud supply source, a first pump configured to inject mud supplied by the mud supply source into the drilling tool, a second pump configured to inject mud supplied by the mud supply source into the annular space from the variable cross section, and a mud-return pipeline configured to return mud in the annular space to the mud supply source;

a Coriolis mass flowmeter provided on the mud-return pipeline;

a Doppler sensor installed on the upper wellbore; and a built-in pressure gauge carrier connected between the drill pipe and the drill bit.

2. The apparatus according to claim 1, wherein the upper wellbore comprises a main cylinder and a bypass pipe, and wherein the main cylinder is coupled to the lower wellbore, the drilling tool is located inside the main cylinder, the bypass pipe is located laterally of the main cylinder, two ends of the bypass pipe are coupled to and communicated with the main cylinder respectively, and the Doppler sensor is mounted on the bypass pipe.

3. The apparatus according to claim 2, wherein the Doppler sensor comprises a transmitter and a plurality of receivers mounted on an outer sidewall of the bypass pipe, the plurality of receivers are arranged at equal intervals along a circumferential direction of the bypass pipe and located on a same radial section thereof, and the plurality of receivers are located above the transmitters in an axial direction of the bypass pipe.

4. The apparatus according to claim 1, wherein the Doppler sensor is provided on the upper wellbore adjacent to the variable cross section.

5. The apparatus according to claim 1, further comprising a comprehensive logging system, which is electrically connected to the Coriolis mass flowmeter.

6. The apparatus according to claim 1, further comprising a data collector, which is electrically connected to the air compressor and the Doppler sensor.

7. The apparatus according to claim 1, wherein the first pump is coupled to the drilling tool through a first mud injection pipeline, the second pump is coupled to the variable cross section through a second mud injection pipeline, and the mud-return pipeline is coupled to the mud supply source and the upper wellbore.

8. The apparatus according to claim 1, wherein the gas-injection pipeline is provided with a solenoid valve, a gas flowmeter, a gas pressure transducer and a check valve.

9. The apparatus according to claim 1, further comprising a prefabricated rock pillar provided in the lower wellbore, wherein the prefabricated rock pillar comprises a plurality of mudstone rock pillars and a plurality of sandstone rock pillars alternately arranged along an axial direction of the lower wellbore; and the prefabricated rock pillar is internally provided with an axially penetrating gas-injection hole having a lower end communicated with the gas outlet end of the gas-injection pipeline.

10. The apparatus according to claim 1, further comprising a test wellbore, a packer and an anchor, wherein the simulation wellbore is provided inside the test wellbore, and the packer and the anchor are provided between the simulation wellbore and the test wellbore.

* * * * *